US012121128B1

(12) United States Patent
Lai et al.

(10) Patent No.: US 12,121,128 B1
(45) Date of Patent: Oct. 22, 2024

(54) HAIR CURLER

(71) Applicant: Jiangxi Shengming Electronic Technology Co., Ltd., Ganzhou (CN)

(72) Inventors: Weiming Lai, Ganzhou (CN); Shengwang Liao, Ganzhou (CN)

(73) Assignee: Jiangxi Shengming Electronic Technology Co., Ltd., Ganzhou (CN)

( * ) Notice: Subject to any disclaimer, the term of this patent is extended or adjusted under 35 U.S.C. 154(b) by 0 days.

(21) Appl. No.: 18/762,745

(22) Filed: Jul. 3, 2024

(30) Foreign Application Priority Data

Jun. 24, 2024 (CN) ..... 202410824194.0

(51) Int. Cl.
*A45D 1/04* (2006.01)

(52) U.S. Cl.
CPC ..... *A45D 1/04* (2013.01)

(58) Field of Classification Search
CPC ... A45D 1/04; A45D 1/00; A45D 1/24; A45D 1/10; A45D 2/00
See application file for complete search history.

(56) References Cited

U.S. PATENT DOCUMENTS

2014/0076349 A1* 3/2014 Deng ..... A45D 1/04 132/211
2022/0142323 A1* 5/2022 Seo ..... A45D 1/28

* cited by examiner

*Primary Examiner* — Rachel R Steitz
(74) *Attorney, Agent, or Firm* — Jeenam Park

(57) ABSTRACT

A hair curler is provided, which includes a grab handle, a control component, a bracket component, and a thermal conductive shell that are sequentially connected; a first heating sheet and a second heating sheet are respectively provided on inner sides of a first frame plate and a second frame plate, a sleeve cover is provided with a first slot portion, one end of a wire barrel is fixed on the sleeve cover. The sleeve cover is provided with a first guide pillar and a second guide pillar at interval. One end of a first wire is connected to the first heating sheet, the other end thereof passes through the first slot portion and is connected to the first guide pillar; one end of a second wire is connected to the second heating sheet, the other end thereof is connected to the first guide pillar.

10 Claims, 6 Drawing Sheets

HAIR CURLER

CROSS-REFERENCE TO RELATED APPLICATIONS

This application claims priority to Chinese Patent Application No. 2024108241940, filed on Jun. 24, 2024, which is hereby incorporated by reference in its entirety.

TECHNICAL FIELD

The present disclosure relates to the field of hair curler technologies, and in particular, to a new hair curler.

BACKGROUND

Hair curler is a common hair perm tool that can be used to shape hair and create various curling effects, the principle of electric heating is usually used, there are different materials such as ceramics and titanium metal, which can adjust the temperature to meet different hair types and styling needs. It can produce different degrees of curling, from small to large, with simple operation and quick completion of styling. The existing hair curlers do not physically separate the heating components, which can lead to short circuits and reduced safety. Furthermore, after multiple uses, poor contact and internal disconnection problems may occur, thereby resulting in easy damage to the hair curlers.

SUMMARY

The present application aims to solve at least one of the above-mentioned technical problems, by providing a new hair curler that can avoid damage to the hair curler and improve safety.

A first aspect of the present application provides a hair curler, which includes a grab handle, a control component, a bracket component, and a thermal conductive shell that are sequentially connected;

the bracket component includes a first component and a second component, where the first component includes a base sleeve, a sleeve cover, a wire barrel, a first wire, a second wire, a third wire, a fourth wire, a first frame plate, a second frame plate, a first heating sheet, and a second heating sheet; the first frame plate and the second frame plate are arranged relative to each other; the first heating sheet and the second heating sheet are respectively provided on inner sides of the first frame plate and the second frame plate; the sleeve cover is provided on one side of the base sleeve, and the sleeve cover is provided with a first slot portion; the wire barrel is located between the first heating sheet and the second heating sheet, one end of the wire barrel is fixed on the sleeve cover, and the second component is fixed on the sleeve cover, the first frame plate and the second frame plate are fixed on the second component;

the sleeve cover is provided with a first guide pillar and a second guide pillar at interval; one end of the first wire is connected to the first heating sheet, the other end of the first wire passes through the first slot portion and is connected to the first guide pillar; one end of the second wire is connected to the second heating sheet, the other end of the second wire passes through the first slot portion and is connected to the first guide pillar; one end of the third wire is connected to the second heating sheet, the other end of the third wire passes through the wire barrel and is connected to the second guide pillar; one end of the fourth wire is connected to the first heating sheet, and the other end of the fourth wire passes through the wire barrel and is connected to the second guide pillar;

the grip handle is configured to input electrical energy through the control component to the first guide pillar and the second guide pillar, the control component is configured to control rotations of the bracket component and the thermal conductive shell, and the thermal conductive shell is configured to conduct heat.

In an embodiment of the present disclosure, the second component includes two side frames that are opposite to each other, the sleeve cover is provided with two second slot portions located on both sides of the first slot portion; one end of each side frame is provided with a fixed insertion angle, and fixed insertion angles of the two side frames are inserted into the two second slot portions; two sides of each side frame are respectively connected to the first frame plate and the second frame plate.

In an embodiment of the present disclosure, the second component includes a top frame and a spacer frame, where the top frame is connected to the other end of each one of the two side frames, the spacer frame is connected to the side where the two side frames face to each other, and the spacer frame is located between the top frame and the sleeve cover.

In an embodiment of the present disclosure, one side of the fixed insertion angle is provided with a bolt fixing hole, the first component includes a support plate and a fixing bolt, the fixing bolt sequentially passes through the support plate and the sleeve cover and is connected to the bolt fixing hole, the first guide pillar and the second guide pillar pass through the sleeve cover and the support plate, and the first guide pillar and the second guide pillar are fixed to the support plate.

In an embodiment of the present disclosure, the control component includes an installation seat, a rotating tail connection seat, and a base; the grip handle is provided with a motor, and the rotating tail connection seat is provided with a rotating shaft; the base is provided with a rotating shaft connection part; one end of the rotating shaft passes through the installation seat and is connected to the bracket component; two ends of the rotating shaft connection part are respectively connected to the other end of the rotating shaft and an output end of the motor.

In an embodiment of the present disclosure, a first through-hole is provided on the installation seat, and a button is provided on the rotating tail connection seat, which passes through the first through-hole.

In an embodiment of the present disclosure, the installation seat is provided with a first countersunk head rod and a second countersunk head rod; the first countersunk head rod is sleeved with a first spring, and the second countersunk head rod is sleeved with a second spring; one end of the first countersunk head rod is connected to the first guide pillar, and one end of the second countersunk head rod is connected to the second guide pillar; the rotating tail connection seat includes a baffle, and the baffle is provided with two second through-holes; the other ends of the first countersunk head rod and the second countersunk head rod are respectively inserted into the two second through-holes; the first spring and the second spring abut against the baffle.

In an embodiment of the present disclosure, the hair curler includes a hair clip, which is rotatably connected to a side wall of the base sleeve.

In an embodiment of the present disclosure, the rotating shaft connection part is provided with a light sensing switch.

In an embodiment of the present disclosure, the grip handle is provided with a control circuit, one side of the grip handle is provided with a power cord, and one end of the thermal conductive shell is provided with an air outlet.

In the hair curler of the present application, the hair curler includes a grip handle, a control component, a bracket component, and a thermal conductive shell that are sequentially connected; the bracket component includes a first component and a second component. The first component includes a base sleeve, a sleeve cover, a wire barrel, a first wire, a second wire, a third wire, a fourth wire, a first frame plate, a second frame plate, a first heating sheet, and a second heating sheet. The first frame plate and the second frame plate are arranged relative to each other, the first heating sheet and the second heating sheet are respectively provided on inner sides of the first frame plate and the second frame plate. The sleeve cover is provided on one side of the base sleeve, and a first slot portion is provided on the sleeve cover. The wire barrel is located between the first heating sheet and the second heating sheet, one end of the wire barrel is fixed on the sleeve cover. The second component is fixed on the sleeve cover, and the first frame plate and the second frame plate are fixed on the second component. The sleeve cover is provided with a first guide pillar and a second guide pillar at interval. One end of the first wire is connected to the first heating sheet, the other end of the first wire passes through the first slot portion and is connected to the first guide pillar. One end of the second wire is connected to the second heating sheet, the other end of the second wire passes through the first slot portion and is connected to the first guide pillar. One end of the third wire is connected to the second heating sheet, the other end of the third wire passes through the wire barrel and is connected to the second guide pillar. One end of the fourth wire is connected to the first heating sheet, and the other end of the fourth wire passes through the wire barrel and is connected to the second guide pillar. The grip handle is configured to input electrical energy through the control component to the first guide pillar and the second guide pillar, the control component is configured to control rotations of the bracket component and the thermal conductive shell, and the thermal conductive shell is configured to conduct heat. The present application can avoid damage to the hair curler and improve safety.

DESCRIPTION OF EMBODIMENTS

Figure 1:
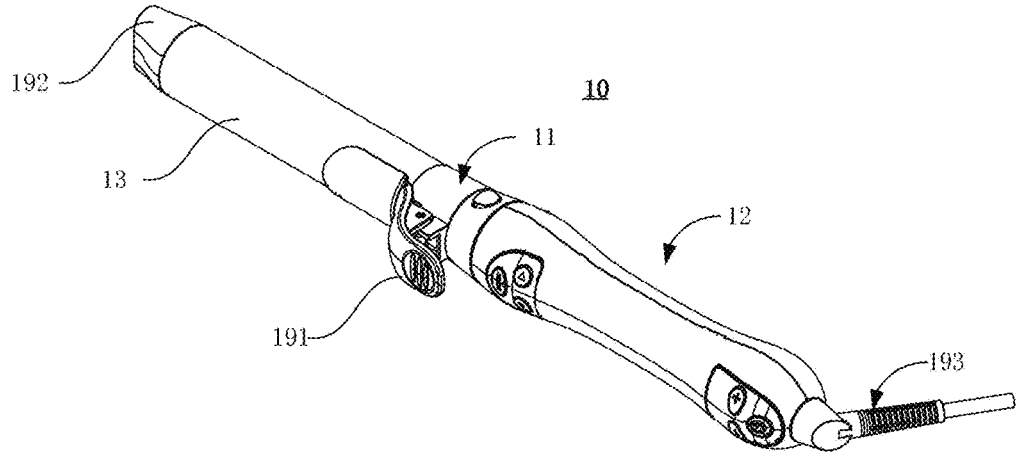
FIG. 1 is a schematic diagram of an overall structure of a hair curler in an embodiment of the present application.

The following will provide a clear and complete description of the technical solution in the embodiments of the present application, in combination with the accompanying drawings. Obviously, the described embodiments are only a part of the embodiments of the present application, not all of them. Based on the embodiments of the present application, all other embodiments obtained by those skilled in the art without creative work fall within the protection scope of the present application.

In the description of the present application, it should be understood that terms "center", "vertical", "transverse", "length", "width", "thickness", "top", "bottom", "front", "back", "left", "right", "vertical", "horizontal", "top", "bottom", "inside", "outside", etc. indicate that an orientation or position relationship based on the orientation or position relationship shown in the drawings is only for a convenience of describing the present application and simplifying the description, and not to indicate or imply that the device or component referred to must have a specific orientation, be constructed and operated in a specific orientation, and therefore cannot be understood as a limitation on the present application. In addition, terms "first" and "second" are only used to describe the purpose and cannot be understood as indicating or implying a relative importance or implying the quantity of technical features indicated. Therefore, the features limited to "first" and "second" can explicitly or implicitly include one or more features. In the description of the present application, "a plurality of" means two or more, unless otherwise specified.

In the present application, term "exemplary" is used to indicate "used as an example, illustration, or explanation". Any embodiments described as "exemplary" in the present application may not necessarily be interpreted as more preferred or advantageous than other embodiments. In order to enable any technical personnel in this field to implement and use the preset application, the following description is provided. In the following description, details are listed for explanatory purposes. It should be understood that ordinary technical personnel in this field can recognize that the present application can also be implemented without using these specific details. In other examples, the structure and process of public knowledge will not be elaborated in detail to avoid unnecessary details that may obscure the description of the present application. Therefore, the present application is not intended to be limited to the embodiments but is consistent with the widest scope of principles and features disclosed herein.

Figure 2:
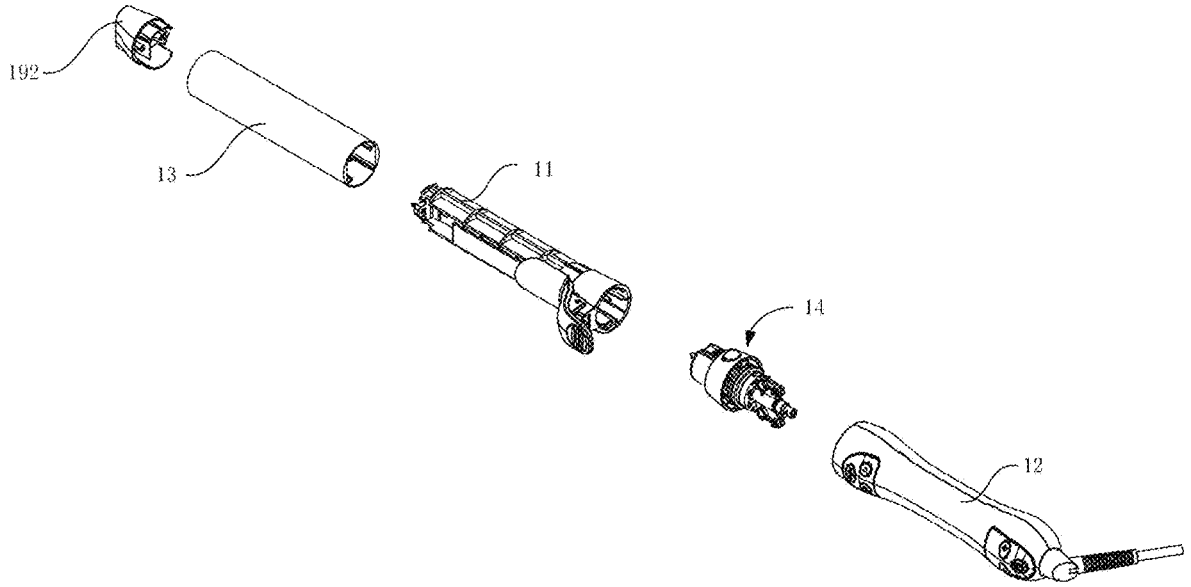
FIG. 2 is a schematic diagram of a first overall explosive structure of the hair curler provided in an embodiment of the present application.
Figure 3:
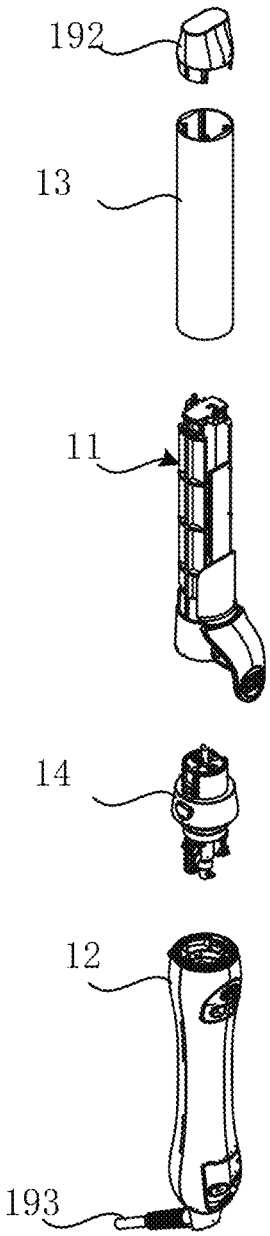
FIG. 3 is a schematic diagram of a second overall explosive structure of the hair curler provided in an embodiment of the present application.
Figure 4:
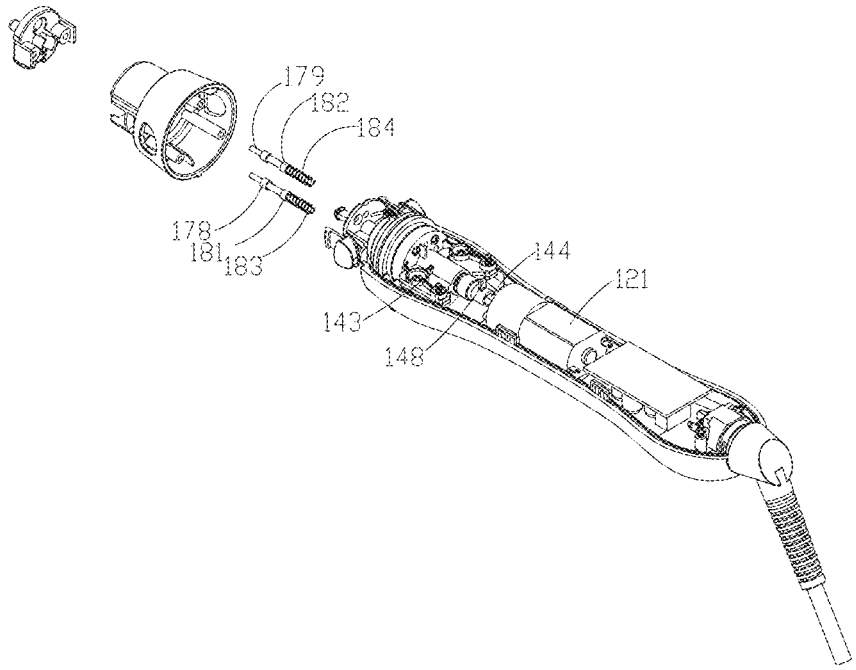
FIG. 4 is a schematic diagram of an internal structure of the hair curler in an embodiment of the present application.
Figure 5:
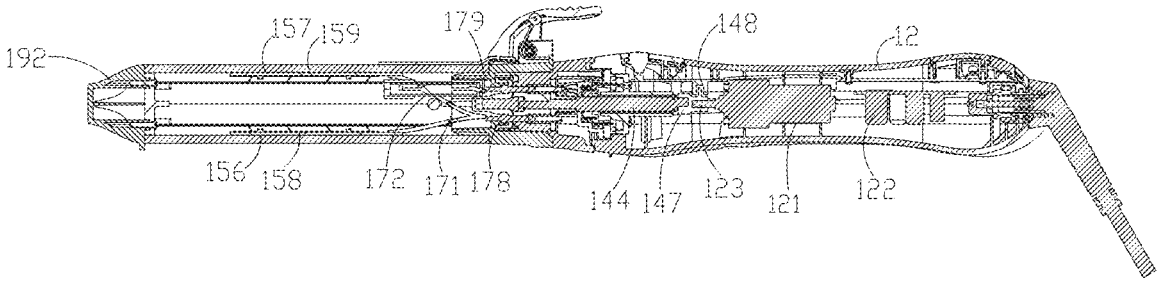
FIG. 5 is a schematic diagram of a cross-sectional structure of the hair curler in an embodiment of the present application.
Figure 6:
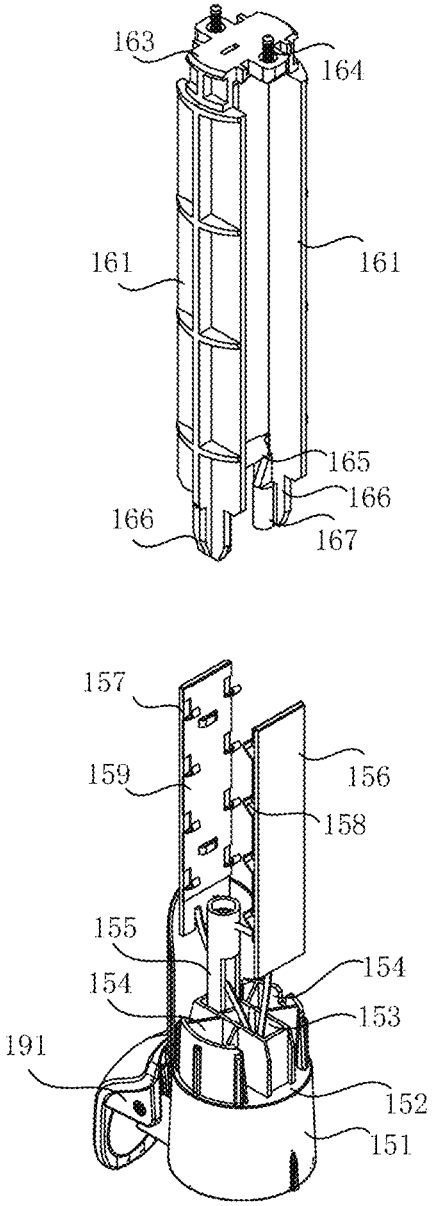
FIG. 6 is a schematic diagram of a first explosive structure of a bracket component of the hair curler in an embodiment of the present application.
Figure 7:
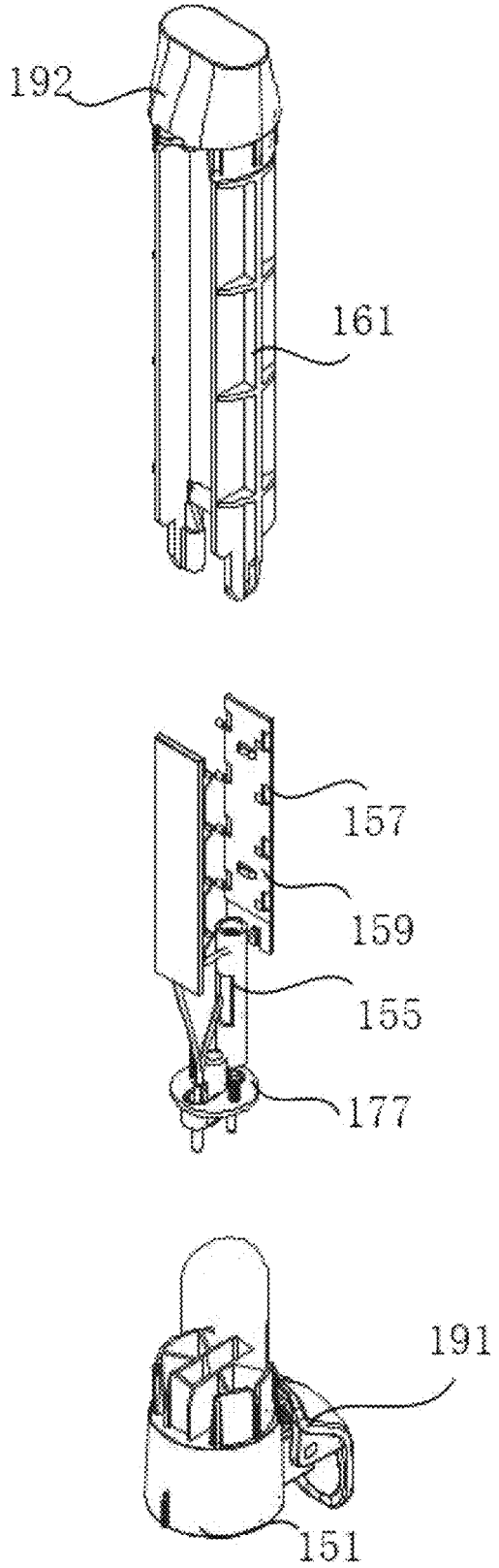
FIG. 7 is a schematic diagram of a second explosive structure of the bracket component of the hair curler in an embodiment of the present application.
Figure 8:
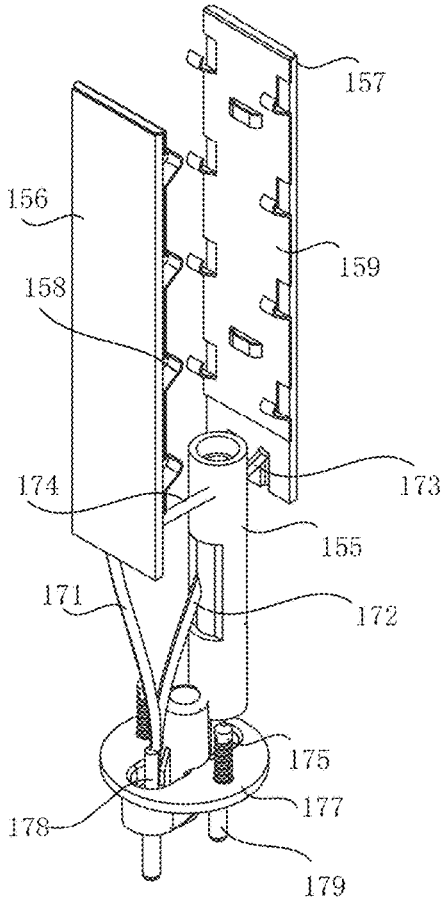
FIG. 8 is a schematic diagram of a local explosive structure of the bracket component of the hair curler in an embodiment of the present application.
Figure 9:
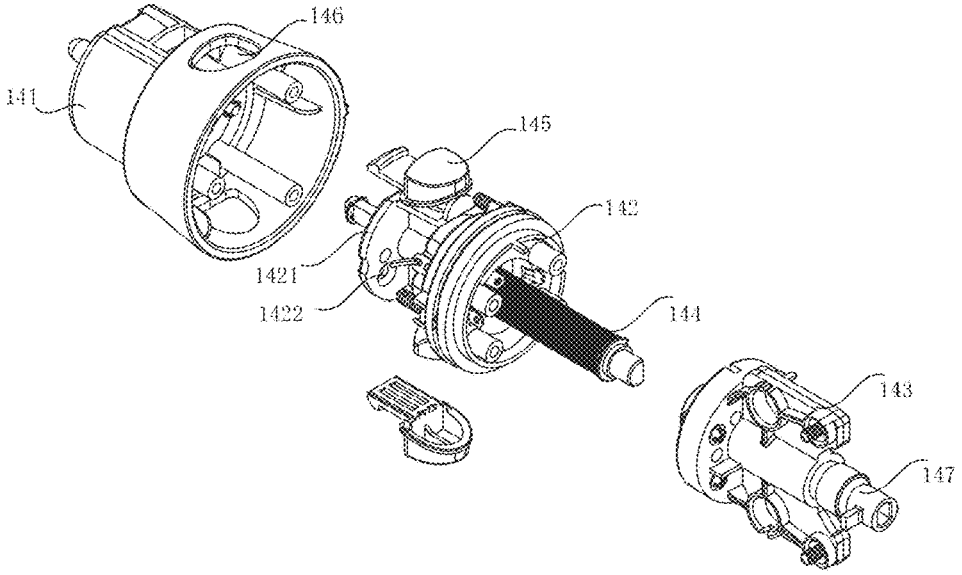
FIG. 9 is a schematic diagram of an explosive structure of a control component of the hair curler in an embodiment of the present application.

Referring to FIGS. 1-9, in this embodiment of the present application, a hair curler 10 includes a grip handle 12, a control component 14, a bracket component 11, and a thermal conductive shell 13 that are sequentially connected.

The bracket component 11 includes a first component and a second component. The first component includes a base sleeve 151, a sleeve cover 152, a wire barrel 155, a first wire 171, a second wire 172, a third wire 173, a fourth wire 174, a first frame plate 156, a second frame plate 157, a first heating sheet 158, and a second heating sheet 159. The first frame plate 156 and the second frame plate 157 are arranged relative to each other, the first heating sheet 158 and the second heating sheet 159 are respectively provided on inner sides of the first frame plate 156 and the second frame plate 157. The sleeve cover 152 is provided on one side of the base sleeve 151, the sleeve cover 152 is provided with a first slot portion 153. The wire barrel 155 is located between the first heating sheet 158 and the second heating sheet 159. One end of the wire barrel 155 is fixed on the sleeve cover 152, the second component is fixed on the sleeve cover 152, and the first frame plate 156 and the second frame plate 157 are fixed on the second component.

The sleeve cover 152 is provided with a first guide pillar 178 and a second guide pillar 179 at interval. One end of the first wire 171 is connected to the first heating sheet 158, the other end of the first wire 171 passes through the first slot portion 153 and is connected to the first guide pillar 178; one end of the second wire 172 is connected to the second heating sheet 159, the other end of the second wire 172 passes through the first slot portion 153 and is connected to the first guide pillar 178; one end of the third wire 173 is connected to the second heating sheet 159, the other end of the third wire 173 passes through the wire barrel 155 and is connected to the second guide pillar 179; one end of the fourth wire 174 is connected to the first heating sheet 158, and the other end of the fourth wire 174 passes through the wire barrel 155 and is connected to the second guide pillar 179.

The grip handle 12 is configured to input electrical energy through the control component 14 to the first guide pillar 178 and the second guide pillar 179. The control component 14 is configured to control rotations of the bracket component 11 and the thermal conductive shell 13, and the thermal conductive shell 13 is configured to conduct heat.

In this embodiment, the second component includes two side frames 161 that are opposite to each other, the sleeve cover 152 is provided with two second slot portions 154 located on both sides of the first slot portion 153. One end of each side frame 161 is provided with a fixed insertion angle 166, and fixed insertion angles 166 of the two side frames 161 are inserted into the two second slot portions 154. Two sides of each side frame 161 are respectively connected to the first frame plate 156 and the second frame plate 157.

In this embodiment, the second component includes a top frame 163 and a spacer frame 165. The top frame 163 is connected to the other end of each one of the two side frames 161, the spacer frame 165 is connected to the side where the two side frames 161 face to each other. The spacer frame 165 is located between the top frame 163 and the sleeve cover 152.

In this embodiment, one side of the fixed insertion angle 166 is provided with a bolt fixing hole 167. The first component includes a support plate 177 and a fixing bolt 175. The fixing bolt 175 sequentially passes through the support plate 177 and the sleeve cover 152 and is connected to the bolt fixing hole 167. The first guide pillar 178 and the second guide pillar 179 pass through the sleeve cover 152 and the support plate 177, and the first guide pillar 178 and the second guide pillar 179 are fixed to the support plate 177.

In this embodiment, the control component 14 includes an installation seat 141, a rotating tail connection seat 142, and a base 143. The grip handle 12 is provided with a motor 121, and the rotating tail connection seat 142 is provided with a rotating shaft 144. The base 143 is provided with a rotating shaft connection part 147, one end of the rotating shaft 144 passes through the installation seat 141 and is connected to the bracket component 11. Two ends of the rotating shaft connection part 147 are respectively connected to the other end of the rotating shaft 144 and an output end 123 of the motor 121.

In this embodiment, a first through-hole 146 is provided on the installation seat 141, and a button 145 is provided on the rotating tail connection seat 142, which passes through the first through-hole 146.

In this embodiment, the installation seat 141 is provided with a first countersunk head rod 181 and a second countersunk head rod 182. The first countersunk head rod 181 is sleeved with a first spring 183, and the second countersunk head rod 182 is sleeved with a second spring 184. One end of the first countersunk head rod 181 is connected to the first guide pillar 178, and one end of the second countersunk head rod 182 is connected to the second guide pillar 179. The rotating tail connection seat 142 includes a baffle 1421, and the baffle 1421 is provided with two second through-holes 1422. The other ends of the first countersunk head rod 181 and the second countersunk head rod 182 are respectively inserted into the two second through-holes 1422. The first spring 183 and the second spring 184 abut against the baffle 1421.

In this embodiment, the hair curler 10 includes a hair clip 191, which is rotatably connected to a side wall of the base sleeve 151.

In this embodiment, a light sensing switch 148 is provided on the rotating shaft connection portion 147.

In this embodiment, the grip handle 12 is provided with a control circuit 122, one side of the grip handle 12 is provided with a power cord 193, and one end of the thermal conductive shell 13 is provided with an air outlet 192.

In the hair curler of the present application, the hair curler includes a grip handle, a control component, a bracket component, and a thermal conductive shell that are sequentially connected; the bracket component includes a first component and a second component. The first component includes a base sleeve, a sleeve cover, a wire barrel, a first wire, a second wire, a third wire, a fourth wire, a first frame plate, a second frame plate, a first heating sheet, and a second heating sheet. The first frame plate and the second frame plate are arranged relative to each other, the first heating sheet and the second heating sheet are respectively provided on inner sides of the first frame plate and the second frame plate. The sleeve cover is provided on one side of the base sleeve, and a first slot portion is provided on the sleeve cover. The wire barrel is located between the first heating sheet and the second heating sheet, one end of the wire barrel is fixed on the sleeve cover. The second component is fixed on the sleeve cover, and the first frame plate and the second frame plate are fixed on the second component. The sleeve cover is provided with a first guide pillar and a second guide pillar at interval. One end of the first wire is connected to the first heating sheet, the other end of the first wire passes through the first slot portion and is connected to the first guide pillar. One end of the second wire is connected to the second heating sheet, the other end of the second wire passes through the first slot portion and is connected to the first guide pillar. One end of the third wire is connected to the second heating sheet, the other end of the third wire passes through the wire barrel and is connected to the second guide pillar. One end of the fourth wire is connected to the first heating sheet, and the other end of the fourth wire passes through the wire barrel and is connected to the second guide pillar. The grip handle is configured to input electrical energy through the control component to the first guide pillar and the second guide pillar, the control component is configured to control rotations of the bracket component and the thermal conductive shell, and the thermal conductive shell is configured to conduct heat. The present application can avoid damage to the hair curler and improve safety.

The above are only the embodiments of the present application and do not limit the scope of the present application. Any equivalent structure or equivalent process changes made using the description and drawings of the present application, or directly or indirectly applied in other related technical fields, are also included in the protection scope of the present application.

What is claimed is:

1. A hair curler, comprising a grab handle, a control component, a bracket component, and a thermal conductive shell that are sequentially connected;

the bracket component comprises a first component and a second component, wherein the first component comprises a base sleeve, a sleeve cover, a wire barrel, a first wire, a second wire, a third wire, a fourth wire, a first frame plate, a second frame plate, a first heating sheet, and a second heating sheet; the first frame plate and the second frame plate are arranged relative to each other; the first heating sheet and the second heating sheet are respectively provided on inner sides of the first frame plate and the second frame plate; the sleeve cover is provided on one side of the base sleeve, and the sleeve cover is provided with a first slot portion; the wire barrel is located between the first heating sheet and the second heating sheet, one end of the wire barrel is fixed on the sleeve cover, and the second component is fixed on the sleeve cover, the first frame plate and the second frame plate are fixed on the second component;

the sleeve cover is provided with a first guide pillar and a second guide pillar at interval; one end of the first wire is connected to the first heating sheet, the other end of the first wire passes through the first slot portion and is connected to the first guide pillar; one end of the second wire is connected to the second heating sheet, the other end of the second wire passes through the first slot portion and is connected to the first guide pillar; one end of the third wire is connected to the second heating sheet, the other end of the third wire passes through the wire barrel and is connected to the second guide pillar; one end of the fourth wire is connected to the first heating sheet, and the other end of the fourth wire passes through the wire barrel and is connected to the second guide pillar;

the grip handle is configured to input electrical energy through the control component to the first guide pillar and the second guide pillar, the control component is configured to control rotations of the bracket component and the thermal conductive shell, and the thermal conductive shell is configured to conduct heat.

2. The hair curler according to claim 1, wherein the second component comprises two side frames that are opposite to each other, the sleeve cover is provided with two second slot portions located on both sides of the first slot portion; one end of each side frame is provided with a fixed insertion angle, and fixed insertion angles of the two side frames are inserted into the two second slot portions; two sides of each side frame are respectively connected to the first frame plate and the second frame plate.

3. The hair curler according to claim 2, wherein the second component comprises a top frame and a spacer frame, wherein the top frame is connected to the other end of each one of the two side frames, the spacer frame is connected to the side where the two side frames face to each other, and the spacer frame is located between the top frame and the sleeve cover.

4. The hair curler according to claim 3, wherein one side of the fixed insertion angle is provided with a bolt fixing hole, the first component comprises a support plate and a fixing bolt, the fixing bolt sequentially passes through the support plate and the sleeve cover and is connected to the bolt fixing hole, the first guide pillar and the second guide pillar pass through the sleeve cover and the support plate, and the first guide pillar and the second guide pillar are fixed to the support plate.

5. The hair curler according to claim 4, wherein the control component comprises an installation seat, a rotating tail connection seat, and a base; the grip handle is provided with a motor, and the rotating tail connection seat is provided with a rotating shaft; the base is provided with a rotating shaft connection part; one end of the rotating shaft passes through the installation seat and is connected to the bracket component; two ends of the rotating shaft connection part are respectively connected to the other end of the rotating shaft and an output end of the motor.

6. The hair curler according to claim 5, wherein a first through-hole is provided on the installation seat, and a button is provided on the rotating tail connection seat, which passes through the first through-hole.

7. The hair curler according to claim 6, wherein the installation seat is provided with a first countersunk head rod and a second countersunk head rod; the first countersunk head rod is sleeved with a first spring, and the second countersunk head rod is sleeved with a second spring; one end of the first countersunk head rod is connected to the first guide pillar, and one end of the second countersunk head rod is connected to the second guide pillar; the rotating tail connection seat comprises a baffle, and the baffle is provided with two second through-holes; the other ends of the first countersunk head rod and the second countersunk head rod are respectively inserted into the two second through-holes; the first spring and the second spring abut against the baffle.

8. The hair curler according to claim 7, wherein the hair curler comprises a hair clip, which is rotatably connected to a side wall of the base sleeve.

9. The hair curler according to claim 8, wherein the rotating shaft connection part is provided with a light sensing switch.

10. The hair curler according to claim 9, wherein the grip handle is provided with a control circuit, one side of the grip handle is provided with a power cord, and one end of the thermal conductive shell is provided with an air outlet.

* * * * *